US005544408A

United States Patent [19]

Tippins et al.

[11] Patent Number: 5,544,408

[45] **Date of Patent: *Aug. 13, 1996**

[54] INTERMEDIATE THICKNESS SLAB CASTER AND INLINE HOT STRIP AND PLATE LINE WITH SLAB SEQUENCING

[75] Inventors: George W. Tippins; John E. Thomas, both of Pittsburgh, Pa.

[73] Assignee: Tippins Incorporated, Pittsburgh, Pa.

[ * ] Notice: The term of this patent shall not extend beyond the expiration date of Pat. No. 5,276,952.

[21] Appl. No.: 371,407

[22] Filed: Jan. 11, 1995

Related U.S. Application Data

[63] Continuation-in-part of Ser. No. 123,149, Sep. 20, 1993, Pat. No. 5,414,923, which is a continuation of Ser. No. 881,615, May 12, 1992, Pat. No. 5,276,952.

[51] Int. Cl.[6] ..... B21B 1/00; B21B 13/22

[52] U.S. Cl. ..... 29/527.7; 29/33 C; 29/DIG. 5; 72/202; 72/229

[58] Field of Search ..... 29/527.7, 33 C, 29/DIG. 5; 72/202, 229

[56] References Cited

U.S. PATENT DOCUMENTS

| | | | |
|---|---|---|---|
| 611,565 | 9/1898 | Daniels . | |
| 1,514,179 | 11/1924 | Sheperdson . | |
| 1,622,060 | 3/1927 | Stoop . | |
| 1,771,688 | 7/1930 | Nye . | |
| 1,808,033 | 6/1931 | George et al. . | |
| 3,604,238 | 9/1971 | Asari | 72/206 |
| 4,229,878 | 10/1980 | Ushijima | 29/527.7 |
| 4,503,697 | 3/1985 | Tippins et al. | 72/202 |
| 4,586,897 | 5/1986 | Weber et al. | 432/121 |
| 4,630,352 | 12/1986 | Ginzburg et al. | 289/527.7 |
| 4,698,897 | 10/1987 | Frommann et al. | 29/527.7 |
| 4,793,169 | 12/1988 | Ginzburg | 72/240 |
| 4,958,677 | 9/1990 | Kimura | 164/452 |
| 4,986,341 | 1/1991 | Masuda | 164/477 |
| 5,094,094 | 3/1992 | Muramatsu et al. | 72/200 |
| 5,115,547 | 5/1992 | Rohde | 29/33 C |
| 5,150,597 | 9/1992 | Sekiya et al. | 72/229 |

*Primary Examiner*—Carl J. Arbes

*Attorney, Agent, or Firm*—Webb Ziesenheim Bruening Logsdon Orkin & Hanson, P.C.

[57] ABSTRACT

A method and apparatus of making coiled plate, sheet in coiled form or discrete plate is shown. The apparatus is an intermediate thickness slab caster and inline hot strip and plate line. The apparatus includes a continuous strip caster forming an intermediate thickness strand; a torch or shear cutoff for cutting the strand into a slab of desired length; a feed and run back table including a slab takeoff operable transverse of the table; a slab collection and storage area adapted to receive slabs from the slab takeoff; a reheat furnace receiving slabs from both the slab takeoff and the slab collection and storage area, with the exit of the reheat furnace at the feed and run back table; a single or twin stand hot reversing mill for reducing the slab to a thickness of 1 inch or less in no more than three flat passes; a pair of coiler furnaces located on opposite sides of the hot reversing mill; and a final processing line downstream of the pair of coiler furnaces.

10 Claims, 2 Drawing Sheets

INTERMEDIATE THICKNESS SLAB CASTER AND INLINE HOT STRIP AND PLATE LINE WITH SLAB SEQUENCING

This is a continuation-in-part of U.S. patent application Ser. No. 08/123,149, filed on Sep. 20, 1993, now U.S. Pat. No. 5,414,923, which a continuation of U.S. patent application Ser. No. 07/881,615, filed on May 12, 1992, now U.S. Pat. No. 5,276,952.

FIELD OF THE INVENTION

This invention relates to the continuous casting and rolling of slabs and more particularly to an integrated intermediate thickness caster and a hot reversing mill with flexibility in slab sequencing and processing.

BACKGROUND OF THE INVENTION

As discussed in parent application Ser. No. 08/123,149 and grandparent Application Ser. No. 07/881,615, now U.S. Pat. No. 5,276,952, which are both incorporated herein by reference, the steel industry has tried to combine the hot strip mill and the continuous caster through an inline arrangement so as to maximize production capability and minimize the equipment and capital investment required. However, known prior art integrated mills required very high capital costs and were extremely inflexible as to product mix and thus market requirements.

These difficulties gave rise to the development of the so-called thin slab (of about 2 inches or less in thickness when cast) continuous hot strip mill which typically produces 1,000,000 tons of steel per year as specialized products. There are significant quality and quantity limitations associated with the so-called thin slab casters, as discussed in the parent application.

It is an object of our invention to integrate an intermediate thickness slab caster with a hot reversing mill which balances the rate of the caster to the rate of the rolling mill and which uses less thermal and electrical energy. It is still a further object to adopt an automated system with small capital investment, reasonable floor space requirements, reasonably powered rolling equipment and low operating costs. It is a further object of our invention to provide flexibility in the sequencing and processing of cast slabs.

SUMMARY OF THE INVENTION

Our invention provides for a versatile integrated caster and minimill capable of producing at least 650,000 finished tons a year or more. The facility can produce product 24 inches to 120 inches wide and up to 1,200 PIW. This is accomplished using a casting facility having a fixed and adjustable width mold with a straight rectangular cross section. The caster has a mold which contains enough liquid volume to provide sufficient time to make flying tundish changes. Our invention provides a slab approximately two or three times as thick as the thin cast slab, thereby losing much less heat and requiring a lesser input of Btu's of energy. Our invention provides a slab having a lesser scale loss due to reduced surface area per volume and permits the selective use of a reheat or equalizing furnace with minimal maintenance required. Further, our invention provides a caster which can operate at conventional caster speeds and conventional descaling techniques. Our invention provides for a balanced production capability. Our invention has the ability to separate the casting from the rolling if there is a delay in either end. Our invention allows the cast slabs to proceed directly to the rolling mill bypassing the furnace, where appropriate, adding flexibility to the overall process. In addition, our invention provides for the easy removal of transitional slabs formed when molten metal chemistry changes or width changes are made in the caster.

All of the above advantages are realized while maintaining the advantages of a thin caster which include low ferrostatic head, low weight of slab, straight molds, shorter length molds, smaller required mold radii, low cooling requirements, low burning costs or shear capacity and simplified machine constructions.

Our invention provides an intermediate thickness slab caster integrated with a hot strip and plate line which includes at least one reheat or equalizing furnace capable of receiving slabs from the caster via a slab transfer table or from a slab collection and storage area or from another area. A feed and run out table is positioned at the exit end of the first reheat furnace and inline with both the continuous caster and a single or twin stand hot reversing mill having a coiler furnace positioned on either side thereof. The single or twin stand mill must have the capability of reducing the cast slab to a thickness capable of being coiled of about 1 inch or less in a minimum number of passes, e.g., three flat passes for a single stand and four reducing passes for a twin stand. The combination coil, coiled plate, sheet in coil form or discrete plate final processing line may extend inline and downstream of the hot reversing mill and the integral coiler furnaces. The finishing facilities include a cooling station, a downcoiler, a plate table, a shear, a cooling bed crossover, a plate side and end shear and a piler.

To achieve the necessary balance between the hot reversing mill and the caster, it is necessary to produce slabs having a thickness generally between about 3.5 inches to 6 inches, preferably between 3.75 inches to 5 inches. The slabs are reduced to about 1 inch or less in three flat passes on a single stand hot reversing mill and four reducing passes on a twin stand mill before starting the coiling of the intermediate product between the coiler furnaces as it is further reduced to the desired finished product thickness. Slab width may vary from 24 to 120 inches.

A preferred method of operation includes feeding a sheared or torch cut slab from the caster onto the feed and run back table which either feeds directly to the rolling mill or to the reheat or equalizing furnace via a slab transfer table. The slab transfer table may also feed cast slabs into a slab collection and storage area. The method allows for the feeding of a previously collected and stored slab into the furnace from the slab collection and storage area for further processing.

DESCRIPTION OF THE PREFERRED EMBODIMENT

Figure 1A:
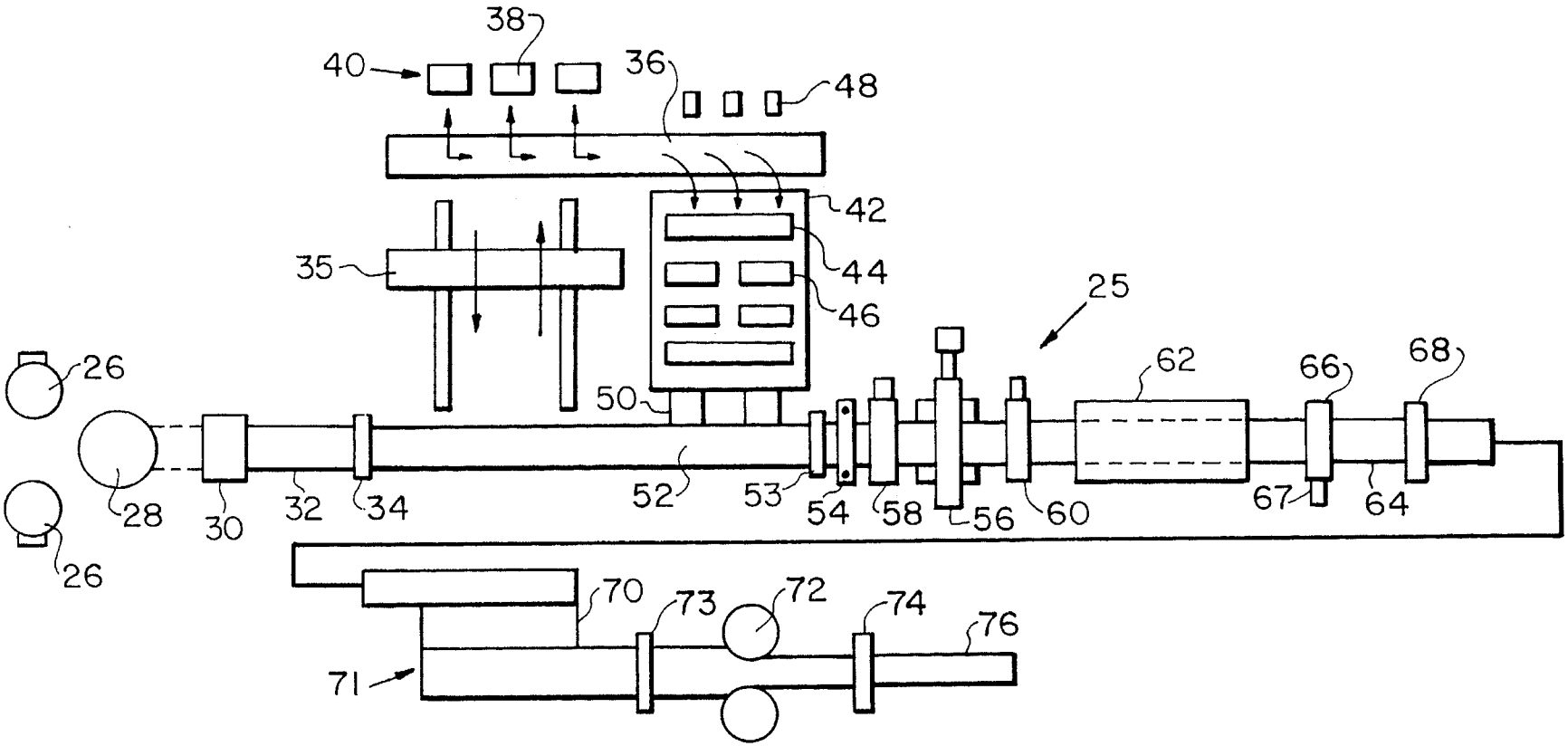
FIGS. 1A and 1B are schematics illustrating the intermediate thickness strip caster and inline hot reversing mill and coiler furnace arrangement according to the present invention.

The intermediate thickness slab caster and inline hot strip and plate line of the present invention is illustrated in FIG. 1A. One or more electric melting furnaces 26 provide the molten metal at the entry end of our combination caster and strip and plate line 25. The molten metal is fed into a ladle furnace 28 prior to being fed into the caster 30. The caster 30 feeds into a mold (curved or straight) 32 of rectangular cross section.

A torch cutoff (or shear) 34 is positioned at the exit end of the mold 32 to cut the strand of now solidified metal into an intermediate thickness slab, about 3.5 to 6 inches thick, of the desired length which also has a width of 24 to 120 inches.

The slab then feeds on a feed and run back table 52 to a slab takeoff area where it may be removed from the feed and run back table 52 by a movable slab transfer table 35 operating transverse to the feed and run back table 52. The slabs are moved by the slab transfer table 35 to a table conveyor 36 to be charged into a furnace 42 or removed from the inline processing and stored in a slab collection and storage area 40 which normally will house slab conditioning facilities of one type or another. The provision of the easily accessible slab collection and storage area allows for a decoupling of the caster and the downstream processing. For example, if the mill goes off-line during a casting, the remaining casts may be forwarded to the slab collection and storage area. Additionally, if the caster were off-line, then the downstream processing can be continued with outsourced slabs. The slab collection and storage area 40 allows individual slabs to be collected for individual surface processing to address defects in individual slabs. The preferred furnace is of the walking beam type although a walking hearth furnace could also be utilized in certain applications. Full-size slabs 44 and discrete length slabs 46 for certain plate products are shown within walking beam furnace 42. Slabs 38, which are located in the slab collection and storage area 40, may also be fed into the furnace 42 by means of slab pushers 48 or charging arm devices located for indirect charging of walking beam furnace 42 with slabs 38. It is also possible to charge slabs from other slab yards or storage areas. Where slabs are introduced from the slab collection and storage area 40 or from the off-line locations, the furnace 42 must have the capacity to add Btu's to bring the slabs up to rolling temperatures.

Because the intermediate thickness slabs retain heat to a much greater extent than the thin slabs, temperature equalization is all that is required in many modes of operation. Additionally, for certain cast slabs, the internal temperature throughout the slab as it is received on the feed and run back table 52 may be sufficient for rolling directly. In this situation, the slab may be fed directly to downstream processing, bypassing the furnace 42. It is also anticipated that a second furnace may be positioned upstream of the first furnace 42 to increase the flexibility and the control of the current system.

The various slabs are fed through the furnace 42 in a conventional manner and are removed by slab extractors 50 and placed on the feed and run back table 52. Descaler 53 and/or a vertical edger 54 can be utilized on the intermediate thickness slabs. A vertical edger normally could not be used with a slab of only 2 inches or less.

Downstream of feed and run back table 52 and vertical edger 54 is a single stand hot reversing mill 56 having an upstream and a downstream coiler furnace 58 and 60, respectively. Run out table 61 and cooling station 62 are downstream of coiler furnace 60. Downstream of cooling station 62 is a coiler 66 operated in conjunction with a coil car 67 followed by a plate table 64 operated in conjunction with a shear 68. The final product is either coiled on coiler 66 and removed by coil car 67 as sheet in strip or coil plate form or is sheared into plate form for further processing inline. A plate product is transferred by transfer table 70 which includes a cooling bed onto a final processing line 71. The final processing line 71 includes a plate side shear 72, plate end shear 74 and plate piler 76. Of course, the plate product facility is omitted where only coil or coil and sheet product are desired.

The advantages of the subject invention come about as the result of the operating parameters employed and the sequencing flexibility available with the current design. The cast strand should have an intermediate thickness, between about 3.5 inches to about 6 inches, preferably between 3.75 inches to 5 inches. The width can generally vary between 24 inches and 100 inches to produce a product up to 1,000 PIW and higher.

The slab is flat passed back and forth through hot reversing mill 56 in no more than three passes achieving a slab thickness of about 1 inch or less. The intermediate product is then coiled in the appropriate coiler furnace, which in the case of three flat passes would be downstream coiler furnace 60. Thereafter, the intermediate product is passed back and forth through hot reversing mill 56 and between the coiler furnaces to achieve the desired thickness for the sheet in coil form, the coil plate or the plate product. The number of passes to achieve the final product thickness may vary but normally may be done in nine passes which include the initial flat passes. On the final pass, which normally originates from upstream coiler furnace 58, the strip of the desired thickness is rolled in the hot reversing mill and continues through the cooling station 62 where it is appropriately cooled for coiling on a coiler 66 or for entry onto a plate table 64. If the product is to be sheet or plate in coil form, it is coiled on coiler 66 and removed by coil car 67. If it is to go directly into plate form, it enters plate table 64 where it is sheared by shear 68 to the appropriate length. The plate thereafter enters a transfer table 70 which acts as a cooling bed so that the plate may be finished on final processing line 71 which includes descaler 73, side shear 72, end shear 74 and piler 76.

The intermediate thickness continuous caster and hot strip and plate line provides many of the advantages of the thin strip caster without the disadvantages. The basic design of the facility can be predicated on rolling 150 tons per hour on the rolling mill. The market demand will obviously dictate the product mix, but for purposes of calculating the required caster speeds to achieve 150 tons per hour of rolling, one can assume the bulk of the product mix will be between 36 inches and 72 inches. A 72 inch slab rolled at 150 tons per hour would require a casting speed of 61 inches per minute. At 60 inches of width, the casting speed increases to 73.2 inches per minute; at 48 inches, the casting speed increases to 91.5 inches per minute; and at 36 inches of width, the casting speed increases to 122 inches per minute. All of these speeds are within acceptable casting speeds.

The annual design tonnage can be based on 50 weeks of operation per year at 8 hours a turn and 15 turns per week for 6,000 hours per year of available operating time assuming that 75% of the available operating time is utilized and assuming a 96% yield through the operating facility, the annual design tonnage will be approximately 650,000 finished tons.

Figure 1B:
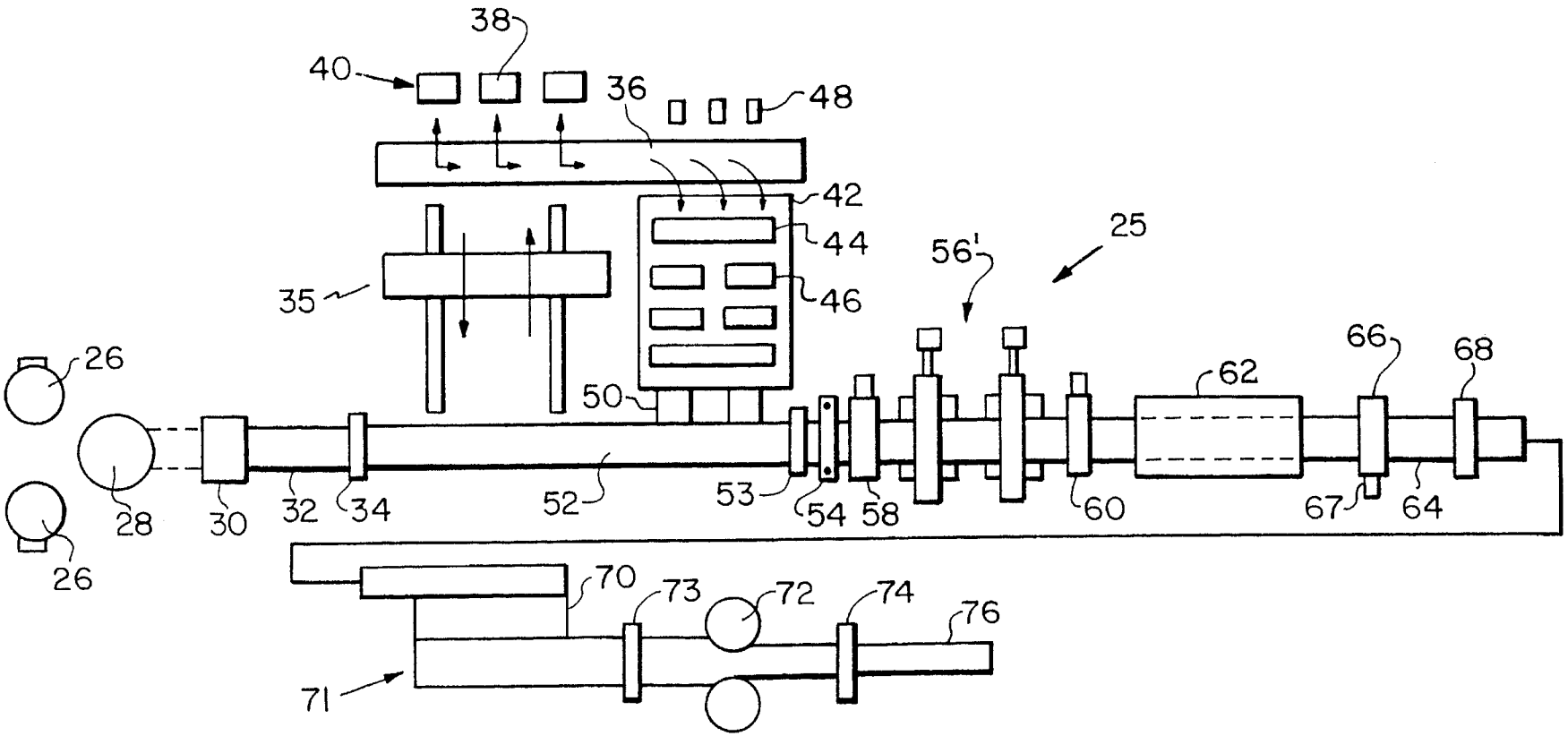

The intermediate thickness slab caster and inline hot strip and plate line according to a modified version of the present invention is illustrated in FIG. 1B. The combination caster and strip and plate line 25 is identical to the line 25 described in connection with FIG. 1A except that a twin stand hot reversing mill 56' replaces the single stand hot reversing mill. The provision of the twin stand increases the rolling capacity of the mill. Additionally, the twin stand mill 56' allows for processing of outsourced slabs which are thicker than the intermediate thickness slabs which could be produced by the caster 30. With the twin stand mill 56' four flat reducing passes on the feed and run back table 52 (with two passes occurring with each passage of the slab along the feed and run back table 52) are normally required to arrive at a thickness capable of being coiled.

Although the present invention has been described in considerable detail with reference to certain preferred versions thereof, other versions are possible. Therefore, the spirit and scope of the appended claims should not be limited to the description of the preferred versions contained herein.

What is claimed is:

1. An intermediate thickness slab caster and inline hot strip and plate line comprising:

a) an intermediate thickness continuous strip caster;

b) an inline cutoff downstream of said caster for cutting an intermediate thickness slab;

c) a feed and run back table inline with said cutoff;

d) a slab transfer table adjacent said feed and run back table operable transverse of said feed and run back table to selectively remove slabs from said feed and run back table;

e) a slab conveyor table adjacent said slab transfer table and adapted to receive slabs from said slab transfer table;

f) a slab collection and storage area adjacent said slab conveyor table adapted to receive slabs from said slab conveyor table;

g) a reheat furnace adjacent said slab conveyor table adapted to receive slabs from said slab conveyor table, said furnace having an exit end positioned adjacent said feed and run back table;

h) a hot reversing mill means inline with said feed and run back table for reducing a slab on said feed and run back table to an intermediate product of a thickness sufficient for coiling in a number of flat passes; and i) a pair of coiler furnaces positioned inline with said feed and run back table, one located upstream of said hot reversing mill means and the other located downstream, said coiler furnaces capable of receiving and paying out said intermediate product as it is passed between said coiler furnaces and through said hot reversing mill means so as to be reduced to an end product.

2. The apparatus of claim 1 wherein said hot reversing mill means includes a pair of rolling mill stands operated in tandem.

3. The apparatus of claim 1 further including a final processing line downstream of said pair of coilers.

4. A method of processing metal slabs comprising the steps of:

a) continuously casting an intermediate thickness strand;

b) cutting said strand into a slab of predetermined length;

c) selectively either:

i) removing said slab from an inline continuous processing line including a hot reversing mill having a coiler furnace on each of an upstream and downstream side thereof and feeding said slab into at least one heating furnace, and extracting said slab to be worked from said heating furnace onto said continuous processing line; or ii) directly feeding said slab to said mill bypassing said furnace;

d) flat passing said slab to be worked back and forth through said mill to form an intermediate product of a thickness sufficient for coiling;

e) coiling said intermediate product in one of said coiler furnaces; and f) passing said coiled intermediate product back and forth through said mill to reduce said coiled intermediate product to an end product of a thickness of equal to or less than about 0.060 inch, said intermediate product being collected in and fed out of each of said coiler furnaces on each pass through said hot reversing mill.

5. The method of claim 4 wherein said hot reversing mill includes a pair of rolling mill stand operated in tandem.

6. A method of processing metal slabs comprising the steps of:

a) providing an intermediate thickness continuous caster and inline cutoff for casting an intermediate thickness strand and cutting said strand into a slab of predetermined length;

b) providing a continuous processing line inline with said caster including a hot reversing mill having a coiler furnace on each of an upstream and downstream side thereof;

c) providing a heating furnace, a slab collection and storage area, and a slab transfer means for selectively moving slabs from said continuous processing line to said slab collection and storage area or said heating furnace;

d) feeding some of said slabs to be worked into said heating furnace wherein said slabs to be worked are from either said intermediate thickness caster or said slab collection and storage area;

e) extracting said slab to be worked from said heating furnace onto said continuous processing line;

f) bypassing said heating furnace with a remaining portion of said slabs to be worked;

g) flat passing each said slab to be worked back and forth through said mill to form an intermediate product of a thickness sufficient for coiling;

h) coiling said intermediate product in one of said coiler furnaces; and i) passing said coiled intermediate product back and forth through said mill to reduce said coiled intermediate product to an end product of desired thickness, said intermediate product being collected in and fed out of each of said coiler furnaces on each pass through said hot reversing mill.

7. The method of claim 6 further including supplying at least one slab to be worked to said heating furnace and said continuous processing line from said slab collection and storage area which was not cast in said intermediate thickness caster.

8. The method of claim 7 wherein said at least one slab to be worked which was not cast in said caster has a thickness greater than said slabs cast by said caster.

9. The method of claim 6 wherein said hot reversing mill includes a pair of rolling mill stands operated in tandem.

10. The method of claim 6 wherein said intermediate product is formed after no more than three flat passes through said hot reversing mill when said slab to be worked is cast in said caster.

* * * * *